US006042320A

United States Patent [19]

McHenry, Jr. et al.

[11] Patent Number: 6,042,320

[45] Date of Patent: Mar. 28, 2000

[54] AUTOMATIC FEEDING SYSTEM FOR HELICALLY FORMED BINDING ELEMENTS

[75] Inventors: David C. McHenry, Jr., Stone Mountain; Philip M. FitzSimons, Atlanta, both of Ga.

[73] Assignee: Unicoil, Inc., Norcross, Ga.

[21] Appl. No.: 08/920,977

[22] Filed: Aug. 29, 1997

[51] Int. Cl.[7] ..... B24B 5/10

[52] U.S. Cl. ..... 412/39; 412/33; 412/38; 412/42

[58] Field of Search ..... 412/33, 38, 39, 412/40, 42, 6, 7; 83/241, 649

[56] References Cited

U.S. PATENT DOCUMENTS

| | | | |
|---|---|---|---|
| 3,902,646 | 9/1975 | Kuhns | 412/37 X |
| 5,364,216 | 11/1994 | Mandel | 412/33 X |
| 5,527,141 | 6/1996 | Malmstrom | 412/38 |
| 5,695,308 | 12/1997 | Hastings et al. | 412/39 |

*Primary Examiner*—Andrea L. Pitts
*Assistant Examiner*—Henry W. H. Tsai
*Attorney, Agent, or Firm*—Berstein & Associates P.C.

[57] ABSTRACT

An automatic feeding station (10) for receiving a plurality of binding elements (70), packaged in a continuous bandolier strip (74), and feeding same into an inserter station (12), for the automatic edge binding of a stack of sheets. The feeding station (12) comprises a housing consisting of a pair of vertically oriented end walls (14,16), and a pair of downwardly extending, angularly disposed walls (18, 20) converging at the bottom of the housing. A first such angular wall (18) defines the feed path for the bandolier strip (74) consisting of a pair of continuous plastic films (76, 78) joined at spaced apart intervals to define plural, laterally oriented pockets or cavities (80) to receive the binding elements (70) in a spaced apart, parallel relationship. Disposed in close proximity to the bottom is a laterally reciprocating pusher member (40), having associated therewith a cutting blade (126) to cut the overriding plastic film (78) to allow the pusher member (40) to feed the binding element (70) through an aperture in one side wall into the inserter station (12). Disposed along the second angular wall (20), near the bottom, is a lateral slot through which the binding element free or spent plastic films are caused to exit the feeding station (10). To facilitate automatic feeding of the bandolier strip (74) for axially positioning the binding element (70) to the pusher member (40), the spent plastic films are caused to pass a pivoting tension roller (88) into a pair of driven pinch rollers (86) to ensure the incremental feeding of the binding elements to the pusher member.

2 Claims, 7 Drawing Sheets

AUTOMATIC FEEDING SYSTEM FOR HELICALLY FORMED BINDING ELEMENTS

FIELD OF THE INVENTION

The present invention is directed to the field of automated equipment for book or document binding, such as by a helically formed binding element, and more particularly to an automated system for feeding said binding elements to an inserter station.

BACKGROUND OF THE INVENTION

Automatic book or document binding, by the use of a helically formed binding element, or coil, is a relatively recent technology. One of the innovators of such technology, and the assignee of this invention, is UNICOIL, INC. of Norcross, Ga., which has developed a line of compact products for punching an aligned row of holes along the edges of a stack of sheets, then automatically inserting a binding element or coil therein, to produce a legal, engineering or marketing type document, for example. With the introduction of color copiers, this new technology has opened the door to new marketing approaches for different products or services.

Until the present development, the binding process was limited by the manual feeding of binding elements to an inserter machine. Briefly, and by way of additional background, the binding elements, typically formed from a continuous reel of plastic filament, ranging in size from about 5 to 50 mm, by helically winding such filament on a mandrel, having a diameter essentially equal to the I.D. of the final binding element, then heating the mandrel and filament to set the helical shape of the binding element. While the binding elements may vary in length, a common length is 11 inches for binding together standard 8½×11 sheets. In any case, the helically set binding elements are cut to size and randomly placed in a suitable container for use in the binding operation. Unfortunately, such binding elements typically become intermingled where removal of one from the container often requires the operator to separate two or more intermingled binding elements. This unnecessarily adds labor costs and slows the effective rate of the insertion process.

The present invention avoids the labor intensive steps of the prior art semi-automatic binding element insertion systems by the provision of an automatic feeding station utilizing a bandolier strip of separately packaged helically wound binding elements, and feeding same into an inserter station without operator handling. The manner by which this labor saving mechanism achieves the desired goals will become apparent in the description which follows, particularly when read in conjunction with the accompanying drawings.

SUMMARY OF THE INVENTION

The present invention relates to an automatic feeding station for receiving a plurality of binding elements, packaged in a continuous bandolier strip, and feeding same into an inserter station, for the automatic edge binding of a stack of sheets. The feeding station comprises a housing consisting of a pair of vertically oriented end walls, and a pair of downwardly extending, angularly disposed walls converging at the bottom of the housing. A first such angular wall defines the feed path for the bandolier strip consisting of a pair of continuous plastic films joined at spaced apart intervals to define plural, laterally oriented pockets or cavities to receive the binding elements in a spaced apart, parallel relationship. Disposed in close proximity to the bottom is a laterally reciprocating pusher member, having associated therewith a cutting blade to cut the overriding plastic film to allow the pusher member to feed the binding element through an aperture in one side wall into the inserter station.

Disposed along the second angular wall, near the bottom, is a lateral slot through which the binding element free or spent plastic films are caused to exit the feeding station. To facilitate automatic feeding of the bandolier strip for axially positioning the binding element to the pusher member, the spent plastic films are caused to pass a pivoting tension roller into a pair of driven pinch rollers to ensure the incremental feeding of the binding elements to the pusher member. A microprocessor is associated therewith to control the lateral reciprocal movement of the pusher member, including limit switches to define the length of movement, and to control the intermittent feeding of the bandolier strip.

Accordingly, an object of this invention is to provide a binding element feeding station, in cooperation with an inserter station, to present a fully automated system for edge binding a stack of sheets, in book-like fashion, without operator handling of the binding elements.

A further object thereof is to provide an edge binding system that is less labor intensive than prior art systems.

These and other objects will become apparent to those skilled in the art from the following specification and drawings.

DETAILED DESCRIPTION OF PREFERRED EMBODIMENT

Figure 1:
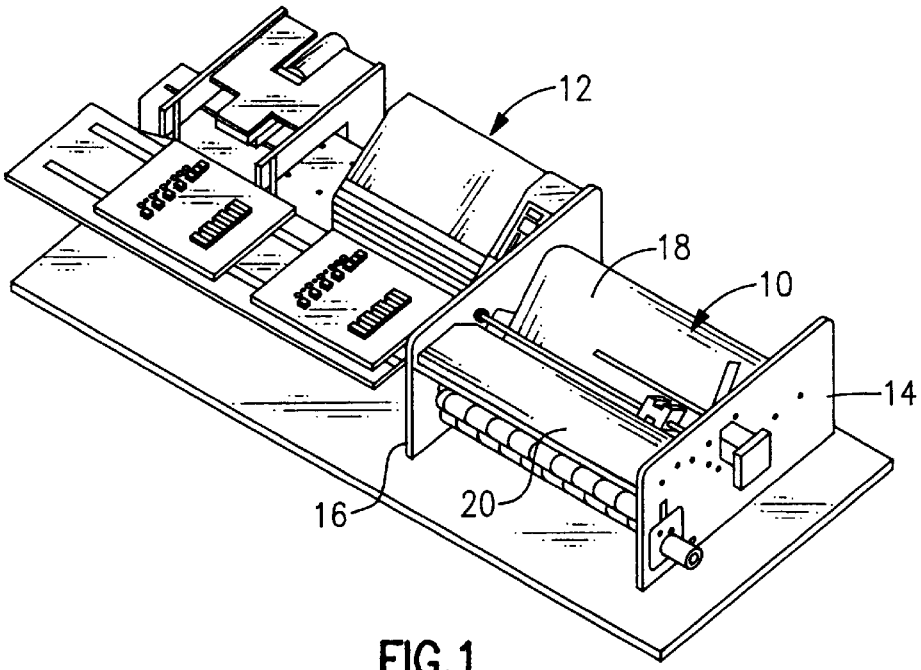
FIG. 1 is a top perspective view of an automatic feeding station for helically wound binding elements according to this invention, where the feeding station is positioned adjacent to and cooperating with an inserter station, for the automatic binding of a stack of sheets, for example, into a book-like form.

The present invention is directed to an automatic binding element feeding station for transferring helically formed binding elements, which when coupled to an associated inserter station, results in a fully automated system for edge binding a quantity of stacked sheets to form a book-like bound product, where such feeding station is illustrated in the various views, with like reference numerals representing like components or features throughout the views.

FIG. 1 is a top perspective view of a binding element system incorporating the automatic binding element feeding station 10, in accordance with this invention, coup led to a binding element inserting station 12, as known in the art.

Figure 2:
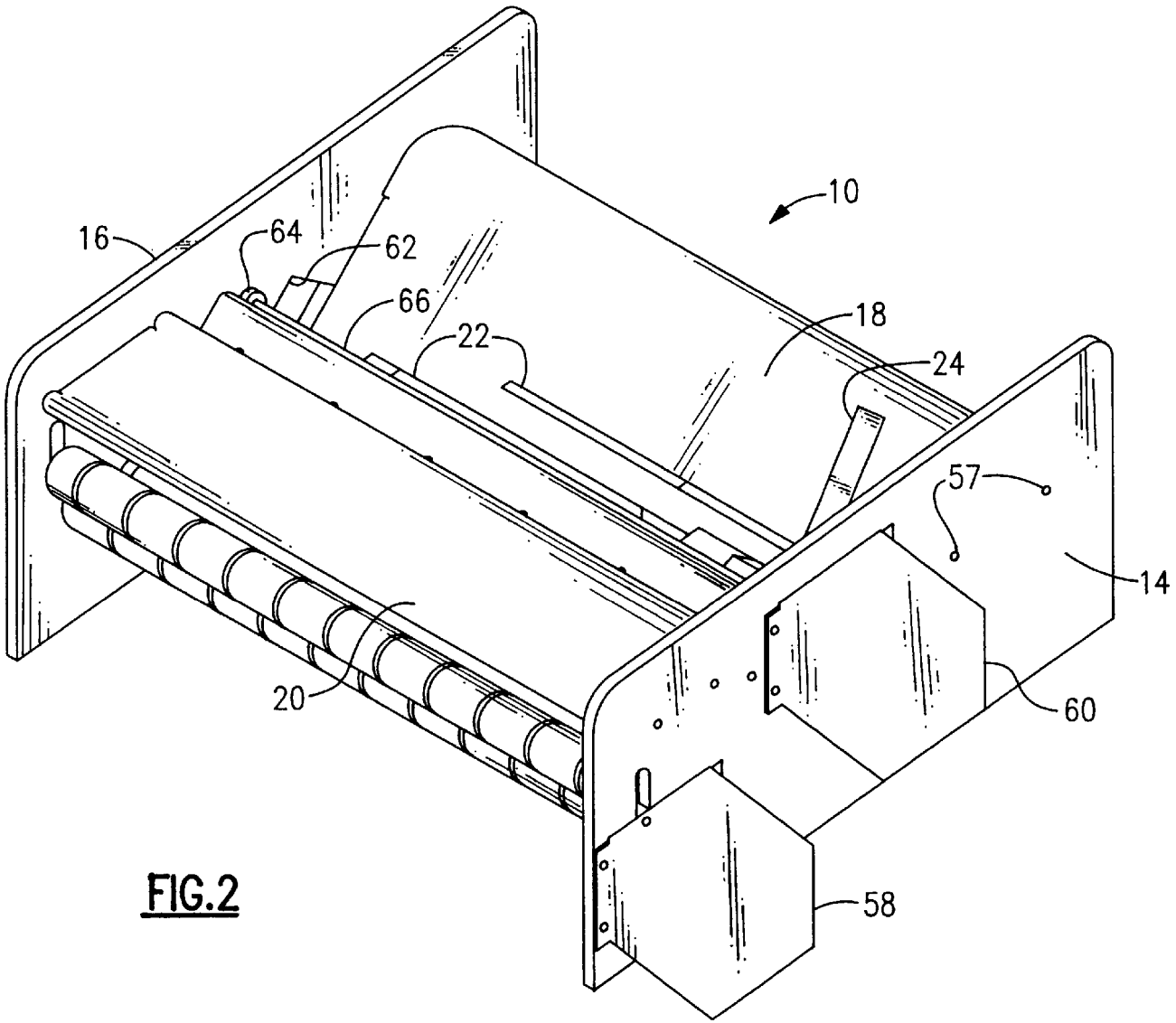
FIG. 2 is an enlarged top perspective view of the automatic feed station of FIG. 1.
Figure 3:
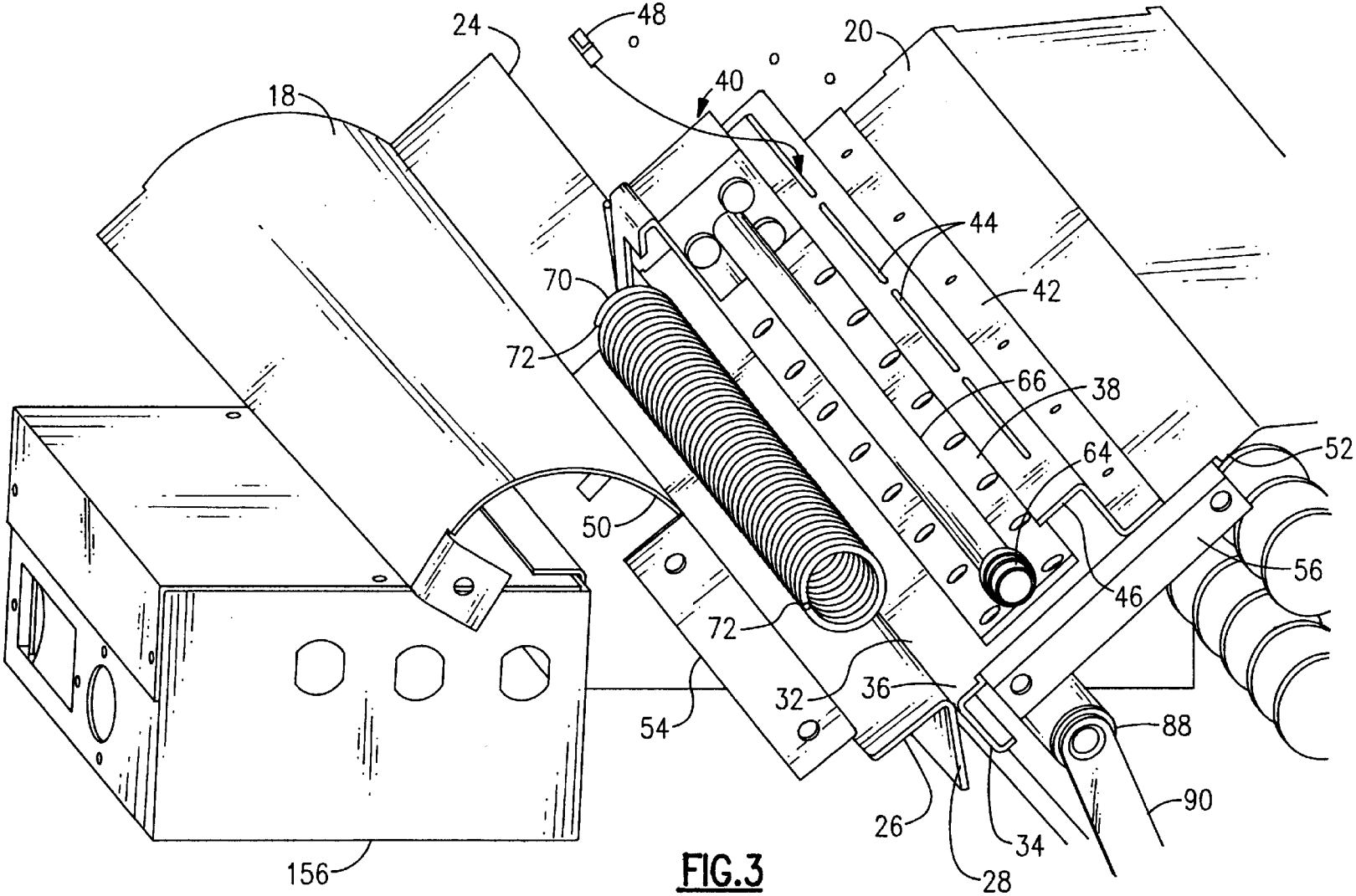
FIG. 3 is a top perspective view of the automatic feeding station, with parts removed for clarity, as seen from the inserter station.

The binding element feeding station 10, a full view of which is illustrated in FIG. 2, essentially comprises a housing having a pair of vertically oriented end walls 14, 16, and a pair of downwardly directed, angularly disposed walls 18, 20, where a first said wall 18 defines a feed path for the binding elements, as hereinafter explained. The first said wall 18 includes a pair of horizontal slots 22 for slidably engaging an edge feed guide 24, where said guide may be slidably adjusted therewithin and fixed according to the length of the binding element. The first said wall 18, as best seen in FIGS. 2 and 3, further includes an upturned bottom edge 26 and a reversibly bent flange 28 therefrom, where said edge and said flange define a first side 30 of an elongated slot 32.

The second said angularly disposed wall 20, essentially planarly aligned with said upturned bottom edge 26 of wall 18, includes an outwardly directed flanged end 34 along its lower edge 36, where said lower edge 36 is spaced from said first side 30 to define a second side to said slot 32, which slot, as described hereinafter, is the exit slot for the spent bandolier strip, and for registering the positions for the binding elements. Further, the second wall 20 includes a bearing plate 38, the purpose of which will become clearer with the description of the binding element pusher mechanism 40 as introduced and described hereinafter. Finally, said second wall 20 has mounted thereon a Z~configured, laterally extending flange 42 having plural aligned slots 44 along leg 46 thereof for mounting a pair of laterally adjustable limit switches 48, only one is shown in an exploded position, where one said switch may be called a "home" switch, defining the start position for the pusher mechanism, and the other a "return" switch to define the end of travel therefor.

The side edges 50, 52 of the angularly disposed walls 18, 20, respectively, are provided with L-shaped flanges or tabs 54, 56 for mounting and securing the vertically oriented end walls 14, 16, such as by fasteners 57, for example. The end wall 14, remote from the inserting station 12, includes first and second motor housings 58, 60, respectively, mounted thereon, for containing motors for reasons to be explained hereafter. The second end wall 16, essentially planar like its counterpart, includes a central opening 62 by which the binding elements are transferred from the feeding station 10 to the inserting station 12. Additionally, said second end wall 16 includes journaling means 64 for rotatably mounting a shaft 66 along which the binding element pusher mechanism 40 travels.

Figure 5:
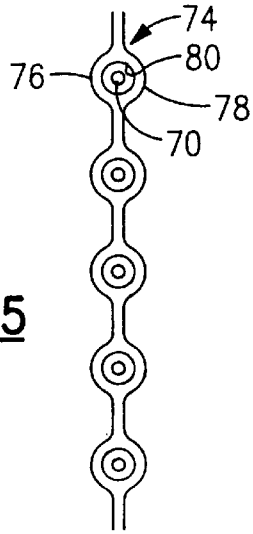
FIG. 5 is a side elevational view of an exemplary bandolier strip, containing plural helically wound binding elements, for the automatic feeding of such elements into the feeding station of this invention.
Figure 5A:
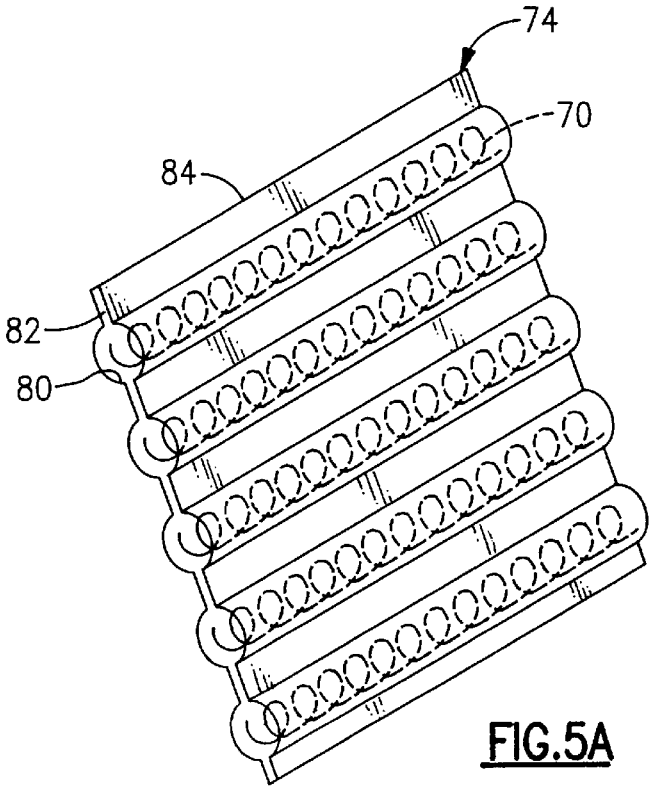
FIG. 5A is a perspective view of the exemplary bandolier strip of FIG. 5.
Figure 4:
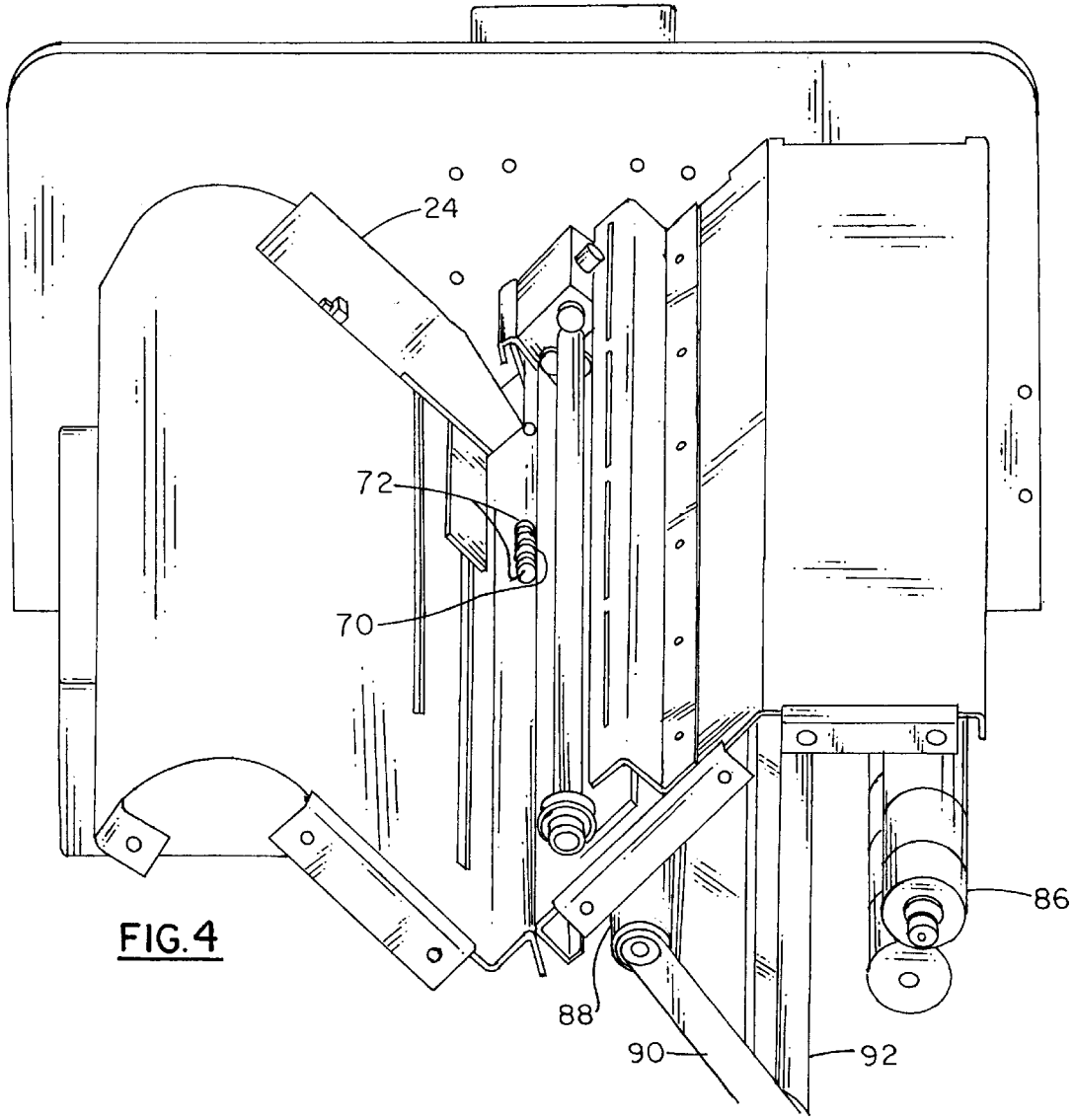
FIG. 4 is a further top perspective view of the automatic feeding station of FIG. 3

The binding elements 70, one shown positioned for transfer in FIG. 4, comprises a helically wound coil, preferably formed of plastic, having a pair of free ends 72 to facilitate insertion into a series of aligned holes along the edge of a stack of sheet, where such holes are spaced apart a distance equal to the convolution spacings of the coil or binding element. In the present invention, the binding elements 70 are packaged individually in a bandolier strip 74 (FIGS. 5 and 5A) where said strip comprises first and second continuous plastic films or sheets 76, 78. Said films 76, 78 are joined together, such as by a hot press, at spaced apart intervals to define plural, open ended cavities 80, where each cavity receives an individual binding element 70. In operation, the bandolier strip 74 is fed down angularly disposed wall 18 with a strip edge 82 thereof lying adjacent the previously adjusted edge feed guide 24. The leading edge 84 of the strip 74 is fed into and through the slot 32, where such leading edge 84 is picked up by a pair of intermittently rotatable pinch rolls 86 driven by a motor, not shown, within the first motor housing 58. By this arrangement, and the positioning of the slot 32 above the planar floor of wall 18, the binding element 70, irrespective of its diameter, will lie tangentially in relation to the slot 32.

As best seen in FIGS. 3 and 10, a pivotally mounted floating roller 88 is positioned to cooperate with said pinch rolls 86 to maintain tension on the exiting bandolier strip. More precisely, the floating roller 88, which may be either spring biased or free floating by virtue of its own weight, is journal led for pivoting movement by arm 90, which is pivotally mounted to fixed roller 92. The operation of the pinch rolls 86 and floating roller 88 will be further described later, and its function better appreciated after the remaining components 6f the feeding station 10 are described.

Figure 6:
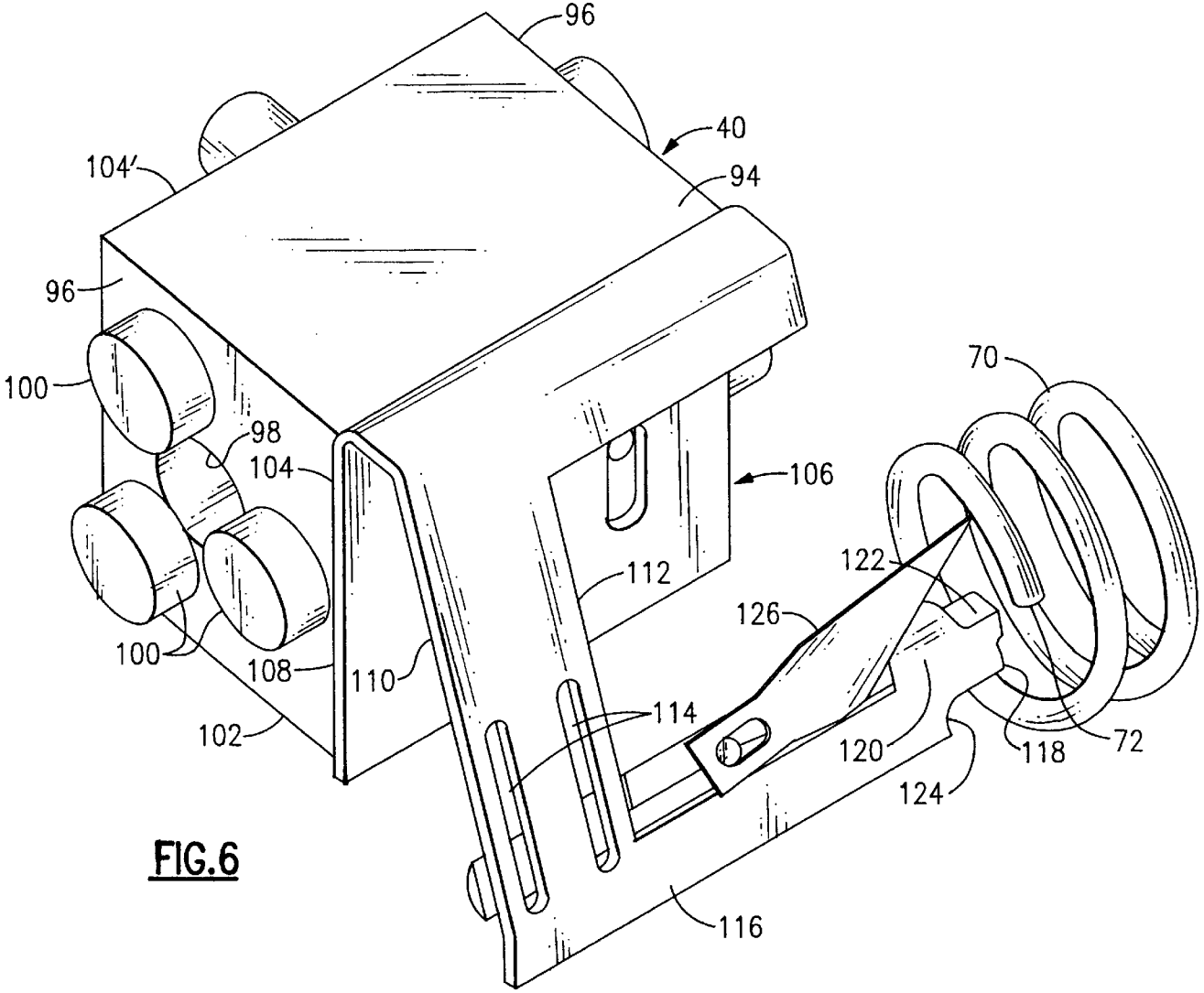
FIG. 6 is an enlarged perspective view of a first embodiment for a binding element pusher mechanism according to this invention, mounting a cutting blade for the bandolier film, taken from the rear of the feeding station.

FIG. 6 illustrates a first embodiment of one of the key components of the feeding station 10 hereof, identified previously as the binding element pusher mechanism 40. The mechanism comprises a generally cubic housing 94 having a pair of endwalls 96, a central through cavity 98 for slidable receiving shaft 66 and extending between the respective end walls 96. Disposed in triangular fashion, about the cavity 98 at each said side wall, are three bearing supported rollers 100, where the rollers thereof are in rolling engagement with said shaft. In operation, rotation of the shaft 66 will cause the cubic housing 94 to traverse the shaft a preselected distance, typically set by the "home" and "return" limit switches 48. A commercial version of a housing and roller assembly suitable for use herein in the practice of this invention is a Rohlix Actuators, ZERO-MAX, by a unit of Barry Wright, Minneapolis, Minn.

In order to fix the relationship of the cubic housing 94 to the feeding station 10, i.e., prevent rotative movement thereof, the housing 94 includes a flat or planar base 102 which rides along the bearing plate 38.

The cubic housing is further characterized by a pair of side walls 104, 104', where one said side wall 104 is provided with a V-configured flanged member 106, as best seen in FIG. 6. One leg 108 thereof is flush mounted to said one side wall 104, with the other leg 110 angularly extending therefrom. Said other leg 110, which is C-configured itself, includes a downwardly extending leg 112, having a pair of parallel slots 114 therein, and a horizontal leg 116 generally aligned with the slot 32. Again, as best seen in FIG. 6, by this arrangement the horizontal leg is also positioned and aligned to contact and laterally push a binding element 70 as the housing 94 travels along the shaft 66. To facilitate the contact and pushing, the free end 118 of horizontal leg 116 is provided with an enlarged pusher head 120 featuring upper and lower curved shoulders 122, 124, respectively, for engaging the open end of the binding element 70.

It will be recalled that the respective binding elements 70 are packaged in a bandolier strip 74 formed of a pair of continuous plastic films 76, 78. To assist in the release of the binding element 70 from between the respective plastic films, the first said embodiment for the pusher mechanism 40 has been provided with a cutting blade 126, adjustably mounted along the parallel slots 114 to accommodate different sized binding elements 70, where the cutting blade 126 severs the plastic film 78 overriding the binding element 70, as the pusher mechanism travels along the shaft 66. Since only the upper film 78 is severed, the integrity of the bandolier strip 74 is maintained allowing the spent or binding element free strip to be continuously removed from the feeding station 10, as described briefly above.

Figure 7:
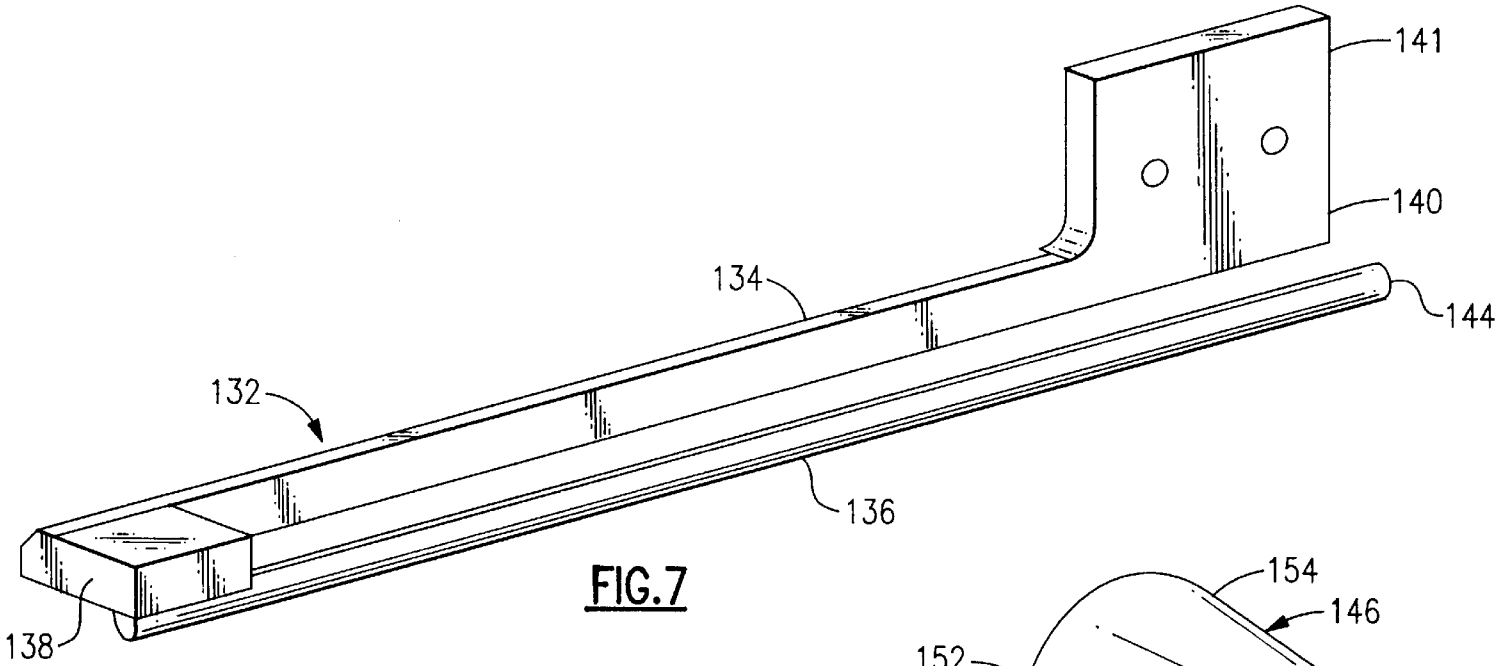
FIG. 7 is an enlarged perspective view of a pusher component for a second embodiment of a binding element pusher mechanism.
Figure 9:
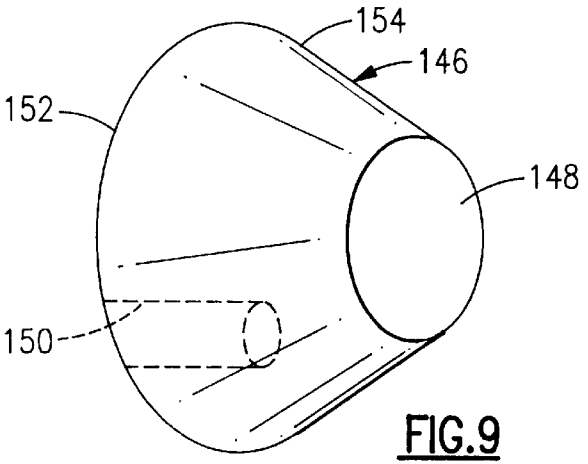
FIG. 9 is a perspective view of a replaceable pusher head member for use with the binding element pusher mechanism of FIGS. 7 and 8, particularly for processing larger binding elements.
Figure 8:
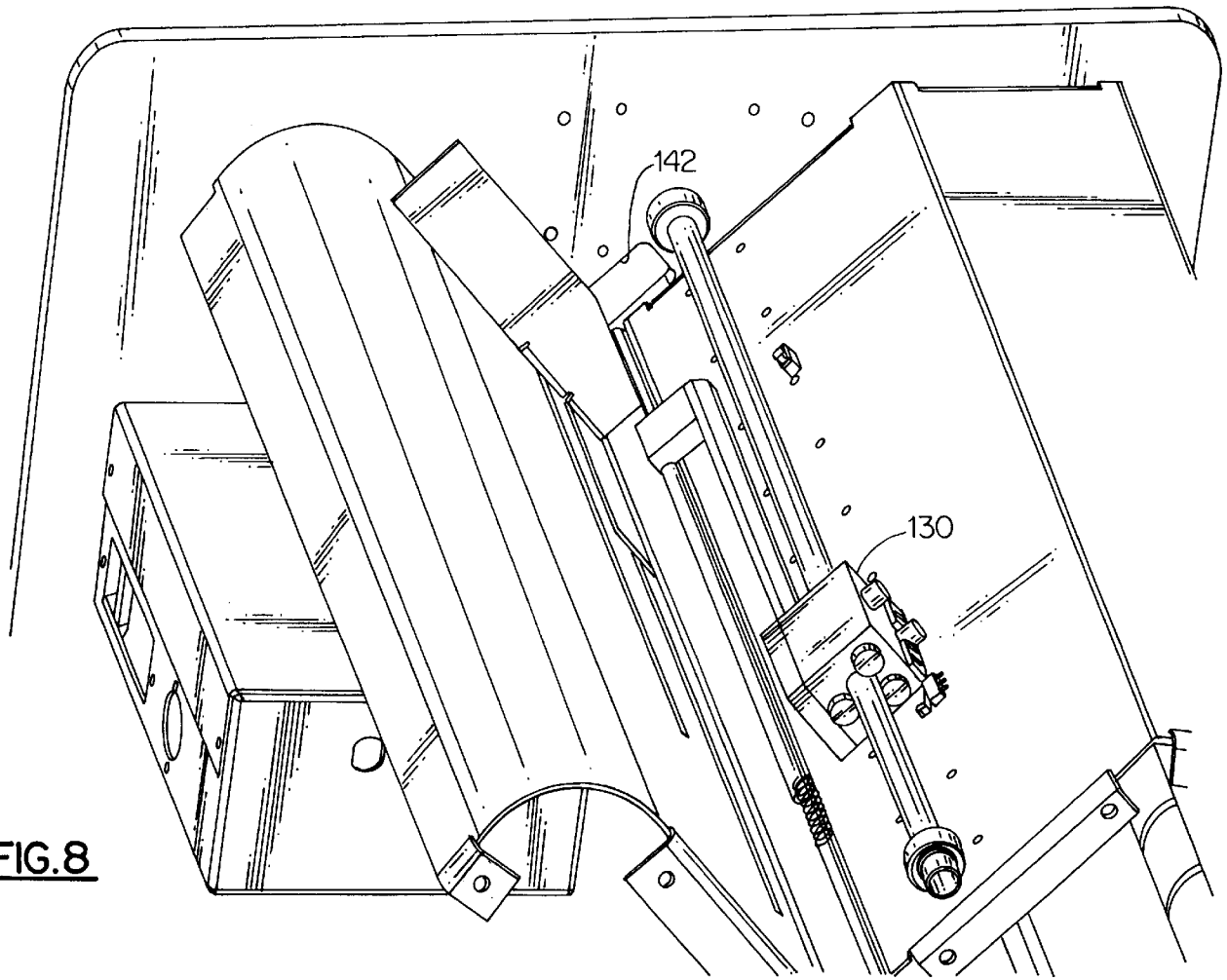
FIG. 8 is a top perspective view, with parts removed of the feeding station illustrating the mounting of the pusher component of FIG. 7 on a binding element pusher mechanism.

The second embodiment for the binding element pusher mechanism 130, illustrated in FIGS. 7 to 9, comprises an elongated U-configured member 132 having a mounting leg 134, a generally circular pusher leg 136, and a connecting member 138 joining said legs in a generally parallel relationship. The distal end 140 of the mounting leg 134 includes an upstanding tab 141 sized to lie contiguous with and be secured to housing wall 104 for reciprocal movement within the feeding station 10. To allow full reciprocal movement of the modified pusher mechanism 130, the outer end wall 14 is provided with an aligned opening 142, as seen in FIG. 8.

The free or distal end 144 of the pusher leg 136 is sized to axially push the respective binding elements through the bandolier cavities 80 or pockets into the adjacent inserter station 12. When processing larger binding elements, namely, those having a diameter greater than about 10 mm., a replaceable pusher head 146 (FIG. 9), suitably keyed, as known in the art, may be placed over the distal end 144, thereby presenting a larger contact face 148 to ensure full circular contact with the binding element. The pusher head 146 includes an off-center opening 150, for keying to said distal end 144, a rear face 152 and a conical or tapered surface 154 extending between the rear and contact faces.

As may be seen in FIGS. 3 and 4, illustrating clearly the relationship of the various components hereof, the spent bandolier strip is caused to exit through slot 32 where it initially contacts floating tension roller 88, thence through the pinch rollers 86 for collection and disposal, as desired. To coordinate the intermittent movement of the pinch rolls 86, and the reciprocal movement of the pusher mechanism 40, a microprocessor 156 has been provided.

While the invention has been described above in it preferred forms, it is recognized that variations may be made with respect to the components hereof, particularly the binding element pusher mechanisms. Accordingly, while the invention has been disclosed in preferred forms only, it may be obvious to those skilled in the art that additions, deletions and modifications can be made therein without departing from the spirit and scope of this invention, and that no undue limits should be imposed thereon except as set forth in the following claims.

What is claimed is:

1. An automated spiral binding feeder system for feeding a helically formed binding element into an inserter station containing a stack of papers having a plurality of prepunched holes aligned along an edge of each paper in said stack, said binding element capable of insertion through said aligned holes to bind said papers in a book-like fashion, where each said binding element is packaged individually in spaced apart relationship along a bandolier strip consisting of a pair of continuous plastic sheets, with said binding elements positioned therebetween, joined together between adjacent said binding elements;

said feeder system comprising a housing having first and second angularly disposed walls converging toward a horizontally positioned binding element pusher mechanism, where said bandolier strip containing binding elements is automatically fed along first said wall toward said binding element pusher mechanism, said pusher mechanism mounted for reciprocal movement for releasing said binding element from said bandolier strip and transmitting same out of said inserter station;

a plastic sheet cutting blade associated with said binding element pusher mechanism for cutting one said plastic sheet, a horizontally disposed slot along said second wall for receiving and removing said binding element free bandolier sheets; and, a motor for reciprocally moving said binding element pusher mechanism, whereby said binding elements are individually caused to exit said feeder system into said inserter station.

2. An automated spiral binding feeder system for feeding a helically formed binding element into an inserter station containing a stack of papers having a plurality of prepunched holes aligned along an edge of each paper in said stack, said binding element capable of insertion through said aligned holes to bind said papers in a book-like fashion, where each said binding element is packaged individually in spaced apart relationship along a bandolier strip consisting of a pair of continuous plastic sheets, with said binding elements positioned therebetween, joined together between adjacent said binding elements;

said feeder system comprising a housing having first and second angularly disposed walls converging toward a horizontally positioned binding element pusher mechanism, where said bandolier strip containing binding elements is automatically fed along first wall toward said binding element pusher mechanism, said pusher mechanism mounted for reciprocal movement for releasing said binding element from said bandolier strip and transmitting same out of said inserter station;

a circular face associated with said binding element pusher mechanism, where said face has a diameter at least equal to the diameter of said helically formed binding element;

a horizontally disposed slot along said second wall for receiving and removing said binding element free bandolier sheets; and a motor for reciprocally moving said binding element pusher mechanism, whereby said binding elements are individually caused to exit from said feeder system into said inserter station.

* * * * *